US006272833B1

(12) United States Patent
Stephan

(10) Patent No.: US 6,272,833 B1
(45) Date of Patent: Aug. 14, 2001

(54) PROCESS AND AN APPARATUS FOR THE MANIPULATION OF AN EMPTY SPOOL ON A TEXTILE MACHINE

(75) Inventor: Adalbert Stephan, Beilngries/Paulushofen (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 09/512,491

(22) Filed: Feb. 24, 2000

(30) Foreign Application Priority Data

Mar. 11, 1999 (DE) ..... 199 10 764

(51) Int. Cl.[7] ..... D01H 9/10

(52) U.S. Cl. ..... 57/281; 57/90; 57/266; 57/268; 57/270; 57/271; 57/272; 57/275; 57/276

(58) Field of Search ..... 57/281, 90, 276, 57/270, 275, 264, 266, 268, 271, 272, 269; 242/473.4–473.7, 474

(56) References Cited

U.S. PATENT DOCUMENTS

| | | | | |
|---|---|---|---|---|
| 4,139,162 | * | 2/1979 | Stahlecker | 57/263 |
| 5,205,118 | * | 4/1993 | Stahlecker | 57/269 |
| 5,337,550 | * | 8/1994 | Mayer et al. | 57/263 |
| 5,495,991 | * | 3/1996 | Raasch et al. | 57/281 |
| 5,588,603 | | 12/1996 | Nakaji . | |
| 5,628,174 | * | 5/1997 | Mack et al. | 57/281 |
| 5,634,603 | * | 6/1997 | Raasch et al. | 57/281 |
| 5,676,323 | * | 10/1997 | Wirz et al. | 57/264 |
| 5,683,046 | * | 11/1997 | Badiali et al. | 57/281 |
| 5,791,575 | * | 8/1998 | Badiali et al. | 57/281 |
| 5,937,629 | * | 8/1999 | Spindler et al. | 57/281 |
| 6,024,205 | | 2/2000 | Adalbert . | |

FOREIGN PATENT DOCUMENTS

| | | | | |
|---|---|---|---|---|
| 2506417A1 | | 8/1976 | (DE) . | |
| 19529566A1 | * | 2/1996 | (DE) | 57/281 |
| 2201168A | | 8/1988 | (GB) . | |

OTHER PUBLICATIONS

German Patent Office Search Report, Jul. 9, 1999.

* cited by examiner

*Primary Examiner*—John J. Calvert
*Assistant Examiner*—Gary L. Welch
(74) *Attorney, Agent, or Firm*—Dority & Manning

(57) ABSTRACT

On a textile machine, arL empty spool (12) is conveyed along a multiplicity of spool stations (1) situated next to one another. In a predetermined position relative to a grasping apparatus (3) the said empty spool (12) is stopped and is picked up by said grasping apparatus (3), and held by its circumferential surface. After its being lifted by the grasping apparatus (3), the spool (12) is retained in an axial alignment. This retention is discontinued, before the spool (12) is released at the spool station (1) where it is required. For the execution of this procedure, a retaining arrangement (8), composed of stopping devices (4 and 5), is provided for the spool (12) which is held by the grasping apparatus (3). The retaining arrangement (8) idles in a location outside of the transport path which the empty spool (12) will occupy when held. From this idle position, the retaining arrangement (8) can be brought into an operational position, in which it assures the correct axial position of the empty spool (12) which is being held by the grasping apparatus (3).

19 Claims, 2 Drawing Sheets

PROCESS AND AN APPARATUS FOR THE MANIPULATION OF AN EMPTY SPOOL ON A TEXTILE MACHINE

BACKGROUND

The present invention concerns a process in accord with the manipulation of an empty spool on a textile machine and further concerns an apparatus for the carrying out of said process.

Already within the scope of common knowledge is a situation, wherein an empty spool, which is brought to a grasping apparatus by means of a spool conveyor is not to be requisitioned and picked up by the said grasping apparatus, when said spool locates itself at a spinning station which requires a spool, but is called for and picked up at an earlier time, after the conclusion of a transfer of an empty spool at the spool apparatus of a spinning station (see DE 195 29 566 A1). If an empty spool is subsequently requisitioned by a spinning station, then, the grasping apparatus, located in a mobile maintenance conveyance, can be brought to the proper spinning station carrying the previously seized empty spool, whereupon, said maintenance conveyance can immediately start its prescribed work. However, experience has shown, that the immediate attempts to deliver empty spools, which have been carried to the selected spinning station by the said maintenance conveyance, often fail, since the empty spools are not precisely aligned with the spool locating arms of the said selected spinning or spool station.

SUMMARY OF THE INVENTION

Thus the purpose of the present invention is to help overcome those described deficiencies and to assure, that by an optimal and simple method, the empty spool can be delivered at the spool station awaiting service. Additional objects and advantages of the invention will be set forth in part in the following description, or may be obvious from the description, or may be learned through practice of the invention.

In accord with the present invention, the said purpose is achieved. This is done by means of the retaining of the empty spool held by the grasping apparatus, assurance is provided, that the empty spool does not change the relative position it takes in regard to the grasping apparatus because of the operational movement of said grasping apparatus, but that it retains that position from the moment of its pickup by the grasping apparatus.

If the retaining operation is discontinued immediately before the delivery of the empty spool at the spool station which requires it, then a precise positioning of the spool is assured, so that the release of the spool at the spool station can be carried out without problems.

The retaining operation of the empty spool, by a stopping device urged against at least one end of the empty spool while said spool is still in the held pattern, is best carried out and continued, remote from the spool conveyor. The functioning of other maintenance conveyances at the textile machine are not interfered with by this said retaining operation. In order to correct the position of the empty spool on the spool conveyor in relation to the grasping apparatus, if need be, an advantageous improvement of the process of the invention can be provided in which the empty spool is positioned in connection with its retaining arrangement relative to the grasping apparatus.

The retaining of the empty spool relative to the grasping apparatus can be provided at various times and over different intervals. When the grasping apparatus picks up the empty spool to be taken to a spool station, even before it finds itself at the spool station which requires the said spool, the danger arises, that the empty spool, because of shaking during the transport of the maintenance conveyance to the spool station to be handled, changes its position relative to the grasping apparatus. In order to avoid this, a development of the process in accord with the invention is provided in which the empty spool is retained in an axial direction at least during the movement of the grasping apparatus to the spool station which requires the empty spool.

A quick retaining of the empty spool is advantageous. On this account, and in conformance with the invention, provision is made that this axial retaining takes effect even before the grasping apparatus has undertaken its travel to the spool station which requires the empty spool. Favorably, the empty spool may be retained in an axial direction even during the pickup of the spool by the grasping apparatus.

Advantageously, the retaining of the empty spool is not only executed early, but, is retained in an axial direction at least at the beginning of its delivery to the spool station which requires the empty spool. In accord with the invention, an apparatus for carrying out the described process is also provided. The apparatus comprises a maintenance conveyance which can move along a plurality of spool stations arranged next to one another. Also, a grasping apparatus for the pickup of an empty spool in transport on a spool conveyor is provided which grips about the circumferential surface of the spool and moves it to a spool station. The maintenance conveyance further possesses a stopping device for the retention of the empty spool in a predetermined position relative to the grasping apparatus, and is located outside the travel path of the empty spool. This occurs when the spool is held by the grasping apparatus, and the retaining arrangement can be brought into an operational position in which it axially aligns the empty spool held by the grasping apparatus. The stopping device retains the empty spool in an axial direction by urging against at least one end of the empty spool. As stated, the retaining arrangement can assume an idle position, in which it locates itself outside of the operational and movement areas of the grasping apparatus, which latter may be holding the empty spool.

The retaining arrangement, likewise, can assume its expected retaining position, in which the empty spool is kept from moving axially in reference to the grasping apparatus. In this way, assurance is given, that the empty spool assumes the required position at the time of its delivery on the spool holding arms of the spool station which requires said empty spool.

In accord with a simple embodiment of the object of the invention, the stop-apparatus, for the stopping of the empty spool being carried on the spool conveyor to the grasping apparatus, is also a component of the retaining arrangement. It can be brought out of an idling position and into an operating position in a transport path of an empty spool which is moving on a spool conveyor.

In order to achieve a quick retaining of the empty spool relative to the grasping apparatus, an advantageous embodiment of the invented apparatus exists in which the retaining arrangement can be brought quickly into its barrier position.

So that the axial securement of the empty spool need not be interrupted during the period between the pickup of the empty spool by the grasping apparatus to the termination of the travel to the spool station requiring said spool, a development of the apparatus exists. Here, the retaining arrangement maintains its retaining configuration while the grasping apparatus picks up and waits while the maintenance conveyance moves. It is further an advantage, if the retaining arrangement does not need to cease its operations, when the grasping apparatus r eaches the pertinen t spool station. Preferably, the retaining arrangement also maintains its position for the axial alignment of the empty spool., even during at least a portion of the movement for the delivery of the empty spool to the spool equipment of the pertinent spool station.

In order to avoid, that the empty spool being conveyed to the grasping apparatus can assume no position deviating from the desired, relative placement in reference to the grasping apparatus, it is favorable if there is provided an apparatus for the positioning of the empty spool relative to the said grasping apparatus. Here, the retaining arrangement is designed as a positioning apparatus.

Advantageously, the retaining arrangement possesses two retaining bars, between which the empty spool is axially secured. The two bars can be individually or commonly controlled. The bars can be controlled singly in order to stop an empty spool in transport on the spool conveyor, and/or in common to assure axial positioning of the empty spool.

Independently, as to whether the grasping apparatus picks up the empty spool to be delivered to a spool station first at this said spool station or makes the pickup at an earlier time at another spool station, the invention makes it possible, that the spool does not change its position in reference to the grasping apparatus. Otherwise, functional difficulties could arise at the transfer of the empty spool at the spool station which requires said spool. The device needed for this possibility is simple in construction and thus is economical in manufacture. In accord with design and positioning of the said invented device, this device can not only secure the empty spool in the position it held when picked up during travel on the maintenance conveyance to the spool station which requires the spool, but moreover, assure this security during or shortly after the pickup of the spool by the grasping apparatus. This is also true during a t least a part of the deli very action of the grasping apparatus at the spool station requiring the empty spool.

BRIEF DESCRIPTION OF THE DRAWINGS

In the following, an embodiment of the present invention will be more closely described with the help of a drawing. There is shown in.

DETAILED DESCRIPTION

In the following, the invention is explained using an open-end spinning machine with a plurality of spool stations 1 arranged adjacently to one another. It is self explanatory, that the invention could also find application with other types of textile machines to be equipped with empty spools, for instance, a spool machine, which possesses a multiplicity of spool stations located next to one another, or the like.

Figure 1:
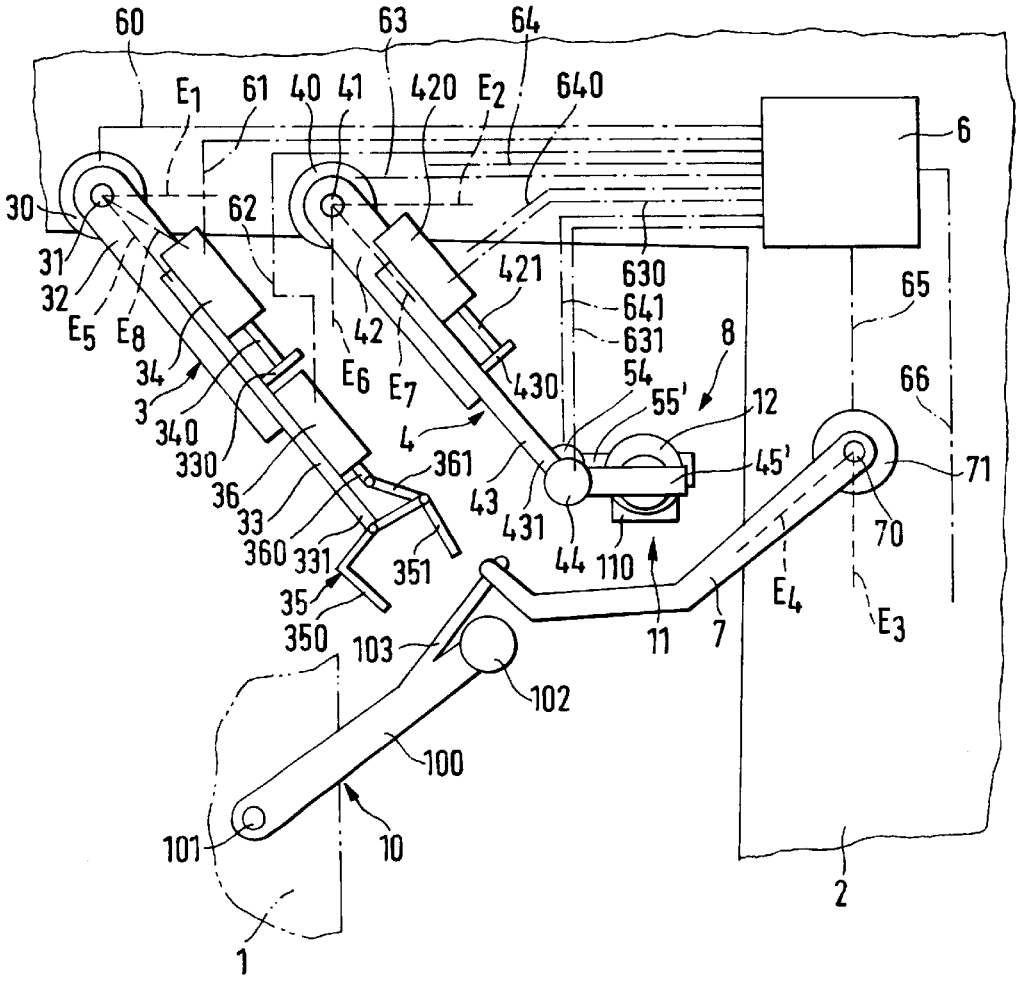
FIG. 1 in profile view, a portion of an open-end spinning machine and a mobile maintenance conveyance with the retaining arrangement in accord with the present invention.

FIG. 1 shows a part of a mobile maintenance conveyance 2, which, in conventional manner, can travel along a plurality of spool stations 1 of an open-end spinning machine. The spool stations are also constructed in the usual manner, on which grounds, a description of their design is unimportant for the understanding of the patent. For this reason, the spool stations 1 are simply indicated in the FIGS. 1, 2.

In a manner not shown, a spool conveyor 11 is supported by the open-end spinning machine, which, in the case of the depicted embodiment possesses as a conveying means a transport belt 110 for the transport of empty spools 12 from a (not shown) spool-magazine for take-over by the maintenance conveyance 2. These empty spools 12 can be constructed cylindrically, in accord with the design or installation of the open-end spinning machine, or may show a specified conical shape.

For the pickup of an empty spool 12 brought on the spool conveyor 11, and for the delivery of said spool 12 to a spool station 1, the maintenance conveyance 2 carries a grasping apparatus 3. This is served by a conventionally designed pivoting drive 30. For simplicity's sake, pivoting drive 30 is shown as a motor, although it is obvious, that instead of a motor, a drive built on another principle such as a hydraulic or a pneumatic cylinder with an appropriate rod can provided.

The grasping apparatus 3 possesses a carrier arm 32 situated on a pivoting axle 31. On this said carrier arm 32 is further placed a slider arm 33 which is slidable axially. The slider arm 33 and the carrier arm 32 possess still further guiding means which are not shown, so that the slider arm 33, independent of its relative position in reference to the carrier arm 32 is continually in alignment, that is, remains parallel to arm 32. For sliding the slider arm 33 relative to the carrier arm 32, a drive 34 is mounted on carrier arm 32. In the depicted version of this drive 34, it is shown in the form of a pneumatic or hydraulic cylinder with a piston rod 340, with which a come-along plate 330 is securely attached.

The slider arm 33, guided and carried by the carrier arm 32, exhibits on its end 331, remote from the pivoting axle 31, a grasper 35 with two grasping claws 350 and 351, wherein, the grasping claw 350 is rigidly integrated with the slider arm 33, while the second grasping claw 351 at the end 331 of the slider arm 33 is pivotably mounted and thus swingable in reference to the grasping claw 350. Thus, the grasper 35 can be opened and closed. The pivoting of the grasping claw 351 is done with the aid of a drive 36, which, in the depicted example, is again designed as a pneumatic or hydraulic cylinder, the thrust piston 360 of which is pivotably connected to the grasping claw 351 by a coupling piece 361.

Figure 2:
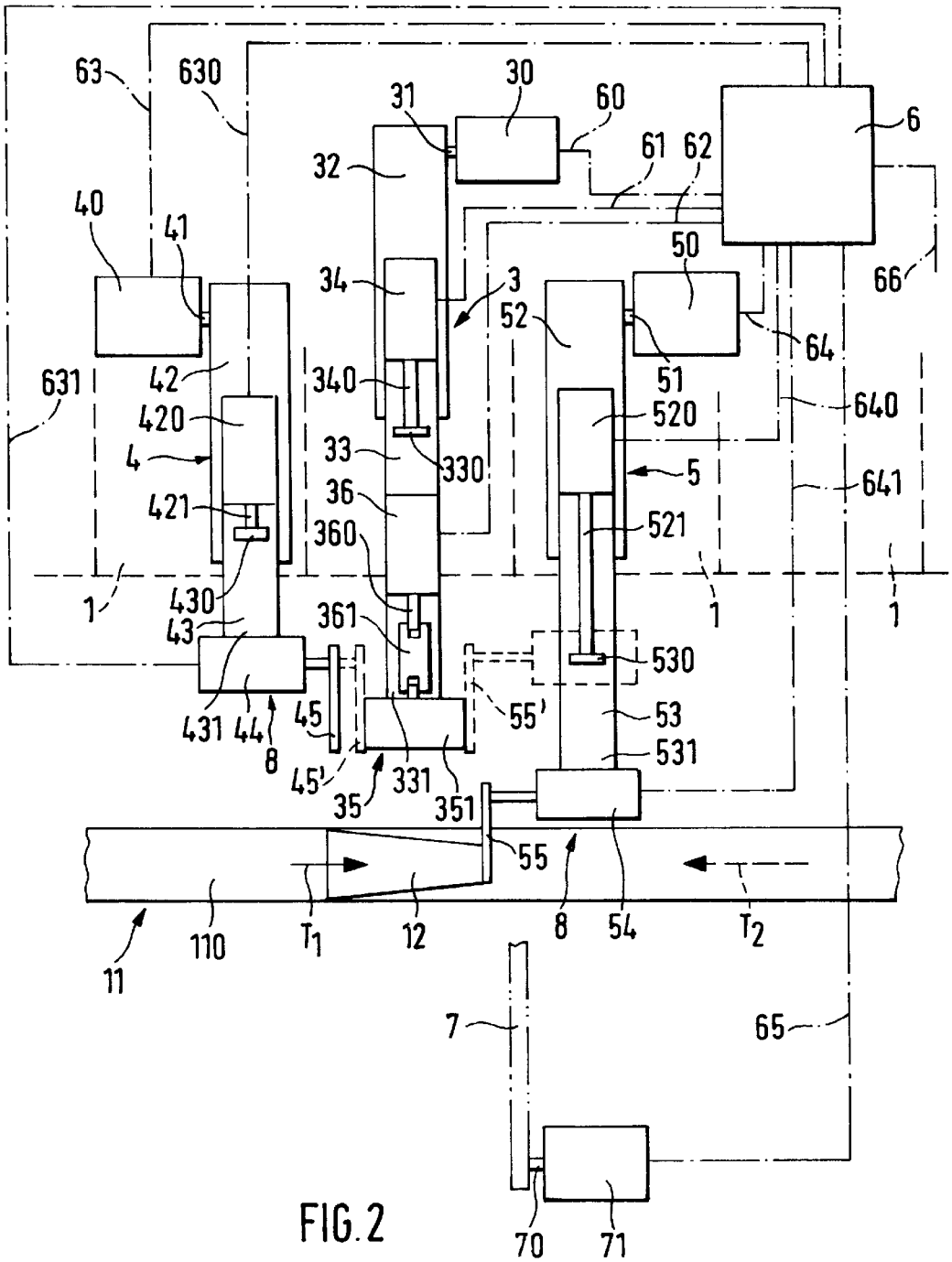
FIG. 2 shows the equipment of FIG. 1 in plan view.

The individual drive elements of the grasping apparatus 3 are controllably connected with a control 6, which connection is shown in the FIGS. 1, 2 with the aid of dashed lines. Thus, the pivoting drive 30 of the grasping apparatus 3 is connected to the control 6 by a line 60 and the drives 34 and 36 are also so connected by means of respectively lines 61, 62.

For the stopping of an empty spool 12 as it is brought by the spool conveyor 11 into a predetermined position opposite the maintenance conveyance 2 and thus also opposite the grasping apparatus 3, the maintenance conveyance 2 carries on both sides of the grasping apparatus 3 stopping devices 4 and 5 (see FIG. 2). To the stopping device 4, 5 is generally assigned a conventionally designed pivoting drive 40, 50 (respectively). As in the case of the grasping apparatus, for simplicity's sake, here, a motor is shown as pivoting drive 40, 50, although it is obvious that instead of this, another drive, possibly in the form of a hydraulic or pneumatic cylinder with appropriate piston rods may be furnished.

Again, similar to the grasping apparatus, each stopping device 4, 5 is borne on carrier arm 42, 52 which possesses pivoting axle 41, 51. Along this carrier arm 42, 52, is supported slider arm 43, 53. The arm slider arm 43, 53 and the carrier arm 42, 52 possess (not shown) coacting guides, so that the slider arm 43, 53, independently of its extended distance, does not lose its parallel positioning to the carrier arm 42, 52.

For the sliding of the slider arm 43, 53 relative to the carrier arm 42, 52, on each of the said carrier arms is placed a drive 420, 520. In the depicted version, this is in the form of a pneumatic or hydraulic cylinder, which, for instance, is securely connected over a piston rod 421, 521 with a come-along plate 430, 530 which latter is integrally bound to the slider arm 43, 53.

The slider arm 43, 53 carries an additional drive 44, 54, on its end 431, 531 remote from the pivoting axle 41, 51. This drive is again shown as a hydraulic or pneumatic cylinder. This drive, 44, 54 carries, that is, exerts force on a retainer bar 45, 55.

As is shown in FIG. 2, the two retainer bars 45 and 55, as well as their drives 44 and 54, are situated and constructed in mirror image toward one another.

Also the two stopping devices, 4 and 5 are in controlling connection with the control system 6. For the connection of the two pivoting drives 40 and 50 to the control system 6, respective control lines 63 and 64 are provided. The connection of the slider drives 420 and 520 with the control system 6, lines 630 and 640 serve. The connection to said control system 6 for the retainer bar drives 44 and 54 is made through lines 631 and 641. In FIG. 1, the lines 64 and 640 are only figuratively indicated and presented as broken off, since the stopping device 5, in this depiction, to the greater part, is placed behind the stopping device 4. In FIG. 2, however, the control lines 64 and 640 are shown completely.

Spool station 1 is likewise principally only sketched in FIG. 1, showing, among other things, a spool assembly 10, wherein only one of two spool carrier arms 100 is visible. These arms 100 are swingingly placed on pivoting axle 101 and each carries, in a customary manner, respectively, a rotatable spool disk 102. The rotatable disks 102 can embrace between them an empty spool 12. The visible spool carrier arm 100 possesses, on its end which is remote from its pivoting axle, an arm 103 extending out beyond the said spool disk 102. A spool lifting arm 7, secured on the mobile maintenance conveyance 2, can be brought into coacting operation with the said arm 103.

The spool lifting arm 7 is swingingly installed by means of a pivoting axle 70 on the mobile maintenance conveyance 2, and possesses a pivoting drive 71 (shown for simplicity as a motor). Principally, this pivoting drive 71 can be constructed in any type and manner, similarly to the previously mentioned pivoting drives 30, 40, and 50 for the grasping apparatus 3 as well as the two stopping devices 4 and 5. This pivoting drive 71 communicates with the control system 6 over line 65, which system 6 in turn, by means of line 66, communicates further with the open end spinning machine.

Now that the apparatus, which is part of the object of the invention, has been described as to its essential components of construction, the function thereof should be described and explained.

The following description is based on a situation, in which the open-end spinning machine, or a textile machine of another type, is operating in good order and the grasping apparatus with its grasper 35 has circumferentially seized an empty spool 12. In this case, the grasping apparatus 3 finds itself, essentially, in a plane $E_1$, while the stopping devices 4 and 5 are situated in a second plane, namely $E_2$. Under these circumstances, the two planes $E_1$ and $E_2$ could, possibly, coincide and form a common plane. In this position both the grasping apparatus 3 as well as the two stop devices 4, 5 are deposed outside of the operational area of any components and parts of the spinning machine and its spool station 1, so that the mobile maintenance conveyance 2 can move unobstructedly along the open-end spinning machine to each spool station, which might, in any way require attention.

By means of corresponding exertion of force of the drives 34, 44, 54 and 420, assurance is given, that the two retainer bars 45 and 55 are brought to, and remain at the two ends of the empty spool 12 which at that moment is being held by the grasping apparatus 3 by means of its grasper 35. This situation provides that the shakings which could occur during the course of a trip of the maintenance conveyance 2 and could be imparted to the empty spool 12, can cause no axial movement of said spool 12 relative to the grasping apparatus 3. The two stopping devices 4 and 5 coact in this respect and form in common a retaining arrangement 8, by which the empty spool 12, held by the grasping apparatus 3, thus within the said grasping apparatus 3, is axially secured or retained in position. A retained position of this type of the retainer bars 45, 55 against the two ends of the empty spool 12 held by the grasping apparatus 3 is shown in FIG. 2 (retainer bars 45', 55'). However, in FIG. 2, the grasping apparatus 3 finds itself in yet another position corresponding to an operational phase, which will be explained later.

If a spool station 1 requires maintenance attention, then it will send an corresponding signal in a normal way to a control device (not shown) within the open-end spinning machine. This signal calls forth another signal over the line 66 to the control system 6 of the maintenance conveyance 2. The control system 6 is also informed as to what kind of maintenance attention is required.

If the maintenance conveyance 2 has come to a spool station 1 which requires attention, then the said maintenance conveyance 2 is, by known means, brought to a stop in a precisely aligned position opposite the spool station 1. This allows the operational elements of the maintenance conveyance 3 designed for the maintenance work which is to be carried on from this point, to be able to coact in exact alignment with the complementary elements for receiving attention and service for the spool station 1. According to what kind of a maintenance task is to be carried out, various kinds of operational sequences are to be executed. If the matter concerned itself with the required maintenance service, such as the correction of a thread breakage, then those operational sequences which were designed for this purpose are carried out in a conventional manner. In such a case, neither the grasping apparatus 3 nor the two stopping devices 4, 5 become involved.

Should the matter be comprised of ejecting a full spool (not shown) from the spool assembly 10 of a spool station 1, and to replace same with by an empty spool 12, then in this case, both the grasping apparatus 3 as well as the two stopping devices 4 and 5 come into action. Here, one of the two stop devices 4 or 5 first operates alone as a stopping device and then later works together with the other stopping device together as a retaining device.

As soon as the mobile maintenance conveyance 2 has properly reached its position opposite to the spool station 1 which requires attention, then the arm pivot drive 71 is activated, whereby the spool lifting arm 7, which, is first located in a plane $E_3$ within the maintenance conveyance 2, is swung out of this location to the spool assembly 10 (see plane $E_4$). In this new position, the spool lift arm grips the arm 103 of the spool assembly 10 and thus lifts away the full spool to be ejected (not shown) from the spool roll (likewise, not shown).

Now, in a conventional and thus not further depicted manner, the full spool (not shown) is ejected out of the spool assembly 10. The filled spool (not shown) is transported to a spool conveyor (not shown) and is conducted by means of this conveyor to a spool collection point, i.e. a spool collection wagon.

The grasping apparatus 3 is now swung out of the plane $E_1$ into the plane $E_5$. Plane $E_5$ passes through the pivoting axle 31 of the grasping apparatus 3, as well as through the center of the rotatable spool disk 102. The said disk 102 is located in the extended spool holding arm 100 which is in its lifting position, being so placed by the spool lifting arm 7. This swinging motion can be initiated before the ejection of the full spool is completed, wherein, it is yet to be made sure, that this motion does not impair the said ejection of the full spool and the motions of the necessary elements to accomplish this task.

So that the empty spool 12, during the pivoting action of the grasping apparatus 3 remains after and well as before in an axial direction, the pivoting drives 40 and 50 are so controlled, that the retaining arrangement 8, which is formed by the two stop devices 4 and 5 in common, follows the pivoting of the grasping apparatus 3 and with its retaining bars 45 and 55, the said retaining arrangement 8 always remains at the two ends of the empty spool 12.

When the grasping apparatus 3 has reached its position in the plane $E_5$, then the two stop devices 4 and 5, as a part of the retaining arrangement 8, take up their position in the plane $E_6$. Even in the case of an eventual extension of the length of the grasping apparatus 3 by the activation of the drive 34, in order to achieve the closest possible proximity to the delivery position for the empty spool 12 on the spool assembly 10, and not to touch the spool disk 102, the two retaining bars 45 and 55 remain as they were at the two ends of the empty spool 12 (see the dashed lines 45' and 55' in FIG. 2).

At this point, it is necessary, by means of corresponding action on the drives 420 and 520, to change the effective operational length (distance between the pivoting axles 441, 51, and the retaining bars 45, 55 respectively) of the retaining arrangement 8, so that the retaining bars 45, 55 can continue to maintain their positions of contact at the ends of the empty spool 12.

If the grasping apparatus 3 has reached its pivot position within the plane $E_5$, then the drives 44 and 54 are activated, whereby the two retaining bars 45 and 55 discontinue the retaining of the empty spool 12, inasmuch as the said bars remove themselves from the two ends of the empty spool held by the grasping apparatus 3 and thus release the empty spool 12 for its delivery to the spool assembly 10. The two stopping devices 4 and 5 now assume their idling positions, in which they locate themselves outside of the operational zone, that is, the movement track of the grasping apparatus 3 as well as that movement area of the empty spool 12 held by said grasping apparatus 3. Furthermore, by so doing, the stopping devices 4, 5 cannot disturb the subsequent delivery of the empty spool 12 to the spool assembly 10.

At this point, the drive 34 of the grasping apparatus 3 is activated and the arm 33, with the grasper 35 is moved far enough into the direction of the central axis of the spool disk 12, that the empty spool 12 is received exactly between the two flexible spool disks 102. These yield to the axial force exerted on them by the empty spool, extend their disks sideways and flexibly clamp the empty spool 12 therebetween, after said spool has reached a precise axial position. At this juncture, the grasping apparatus 3 can release the empty spool 12. On this account, the claw drive 36 was activated, which acting to pull back the grasping claw 351 thereby effecting the said release of the empty spool 351. By means of corresponding activation of the drive 34, action will then be taken, such that the arm 33 is pulled back in the direction towards the pivoting axle 31, whereby the active length of the grasping apparatus 3 is reduced. The delivery of the empty spool 12 to the spool assembly 10 is thus completed.

After the acceptance of the empty spool 12 by the spool assembly 10 of the spool station 1 which required attention, at this said station a conventional spinning-start procedure is carried out. For this purpose, the tip of a thread (not shown) from one of the help-spools of the mobile maintenance conveyance 2 is fed to the empty spool 12 and affixed near to one of its ends. The empty spool 2, then, at the release of the arm 103, sinks into its start position in plane $E_3$because of the retracting pivoting of the spool lifting arm 7.

The empty spool, in this way, comes into contact with the previously mentioned, (not shown) spool roll and the normal spinning process resumes at this station.

So that replacement can be immediately undertaken and carried out at the next spool station 1, which requires an empty spool, allowance has been made that the grasping apparatus 3, just after the described delivery of a previously carried empty spool 12, can immediately pick up a new empty spool 12, without waiting until the mobile maintenance conveyance 2 is moved to this new spool station 1 which requires this new replacement of a full spool by an empty spool.

Before the grasping apparatus 3 can be activated, first, the stop device 5 goes into action and moves ahead of—relative to the transport direction $T_1$ (FIG. 2)—the empty spool 12, which is being transported by the spool conveyor (see FIG. 2). The stop device 5, in doing this, is pivoted out of its mentioned position in plane E6 and moves into its position in the plane $E_7$as shown in FIG. 1. This move is made during the pivoting action of the stop device 5, but not later than reaching the plane $E_7$. At the instant of this pivoting movement, i.e. its initiation—dependent generally on the geometry of the coacting apparatuses—the drive 520 is energized, and the arm 53 extended outwardly, so that this arm 53 reaches its desired position opposite the transport belt 110 of the spool conveyor 11. In this position, the retaining bar 55 carried by the said arm 53 finds itself in the transport path of the empty spool 12. This has the result, that the said empty spool 12, during its travel along the open-end spinning machine and past the plurality of spool assembly 10, runs against the said retaining bar 55, and is prevented from further travel.

The retaining bar 55, the task of which—in common with the retaining bar 45 during the just described phase is to preserve the axial positional security and alignment of the empty spool 12 held by the grasping apparatus 3, operates now alone as a stopping mechanism, in which function retaining bar 55 need not call upon the assistance of the other retaining bar 45.

The position of the retaining bar 55 is so precisely determined, that the empty spool 12, now retained on the transport belt 110, can subsequently be picked up by the grasping apparatus 3.

To serve this purpose, the grasping apparatus 3 with assistance from the pivoting drive 30 is brought into position in the plane $E_8$ and its slider arm 33, upon energizing of the drive 34, is extended outwardly with grasper 35 with open claws 350, 351 in the direction of the spool conveyor 11, whereupon the said grasping apparatus 3 seizes the empty spool 12, by means of the drive 36, which at this point closes said claws 350, 351 about the circumferential shell of the empty spool 12.

The empty spool 12, if desirable, can be held in such a manner as is favorable for a subsequent axial positioning relative to the grasping apparatus 3 and between the claws 350, 351, wherein, first, the empty spool cannot fall out of the grasper 35 and second, can still be pushed axially, should this prove necessary. This axial movement, if required, is accomplished, in that now also the second stopping device 4 is brought into the area of the empty spool 12, which occurs by energizing the pivoting drive 40 as well as the drives 420 and 520. The timing control is so programmed, that the stopping device 4 must be brought, at the earliest possible moment, into an immediately available "ready-position" (not shown) in proximity to the grasping apparatus 3 located now in plane $E_8$. The said "ready position" of the stopping device 4 is so set, that it does not prevent the travel of the empty spool to the point of need for pickup by the grasping apparatus 3. On the other hand, the stopping device 4 requires only a very short time after the seizing of the empty spool 12 by the grasping apparatus 3 to axially embrace the empty spool 12 between itself and the stopping device 5. Now the two coacting stop devices 4 and 5 perform not as stop devices, but form, as previously, the described retaining arrangement 8 for the empty spool 12 held by the grasper 35.

In accord with how the position of the retaining bar 55 is disposed, the empty spool is brought into a definite axial position relative to the grasping apparatus 3 and retained in this said position by the energizing of the drives 44 and 54. The retaining device 8 operates thus additionally as an apparatus for the positioning of the empty spool.

Alternative to the above described arrangement of the empty spool 12 relative to the grasping apparatus 3, provision can also be made, that the drive 54 of the stop device 5, can be activated by the grasping apparatus 3 prior to the seizure of the empty spool. This can be done before, or just as, the retaining bar 55 has reached its spool aligning position opposite the transport band 110 of the spool conveyor band. In this manner, the grasping apparatus 3 can seize the empty spool preemptively in such a manner, that after the pickup of the empty spool, no correction of the position of the said empty spool 12 within the grasper 35 of the grasping apparatus 3 is necessary. If, following the pickup of the empty spool 12 by the grasper 35, the other retaining bar 45 of the stop device 4 is brought up to the empty spool, then said empty spool 12 will be positionally fixed by the two stop devices 4 and 5, without the necessity of its position being corrected. In this case, the two stop devices 4 and 5 will be functioning as retaining arrangements 8 principally in an axial direction.

Now, by appropriate activation of the drive 34, the slider arm 33 of the grasping apparatus 3 is retracted, during which the grasper 35 remains closed. Simultaneously, by energization of drives 420 and 520, the slider arms 43 and 53 of the retaining arrangements 8 are synchronously withdrawn in such a way, that the retaining bars 45 and 55 continually hold and axially align the newly picked up empty spool 12 between them. Then the pivoting drives 30, 41 and 51 are put in motion, so that the grasping apparatus 3 as well as the retaining arrangement 8 again resume their start positions in the planes $E_1$ and $E_2$. As this is done, the operation of the drives 34, 420 and 520 are so sequenced, one after the other, that the retaining bars 45, 55 do not leave their axial positions at the two ends of the empty spool.

Not only the process, but also the apparatuses can be changed in a multitude of ways within the framework of the invention. For instance, by the exchange of given features for equivalent features or other combinations of features. Thus, it is not unconditionally necessary that the mobile maintenance conveyance 2 carries an empty spool 12 destined for a spool station 1 to another place than that, where the empty spool is needed.

For instance, let the maintenance conveyance 2 find itself in direct proximity to a spool station 1, which is to be equipped with an empty spool 12. Assume further that the said empty spool 12 is to be retrieved and conducted by said conveyance 2 from a place remote from the said spool station. Then it is only practical, that the maintenance conveyance 3 travel to this said proximal spool station and there await the arrival of an empty spool 12. This is to be seen as practical, since this mode of procedure is more saving of time, than if the maintenance conveyance 2 would travel further to acquire a distant empty spool 12, and then return to execute the service to be performed and the original spool station 1.

In which operational program the grasping apparatus 3 and the stop apparatuses 4 and 5 function, is dependent on the requirements of the current application and can change from one type of maintenance operation to another.

When the maintenance conveyance 2 travels to confront the empty spool 12 which is approaching it, then the grasping apparatus 3 and the retaining arrangement 8 assume their depicted (FIG. 1) positions in the planes $E_1$ and $E_2$ during the travel of the maintenance conveyance 2. This is done before the an empty spool 12 is seized by the grasping apparatus and is secured by the retaining arrangement 8.

At the spool station 1, which is to be serviced, the mobile maintenance conveyance is stopped in a customary manner, and aligned precisely to the spool station to be serviced. The stop devices 4, 5 preceded, in the sense of the transport direction $T_1$, the empty spool 12 traveling on the transport band 110 and said stop devices 4, 5 are swung into the plane $E_7$, in which position they had been found as a part of the retaining arrangement 8 during the travel of the maintenance conveyance 2.

By the control of the drive 420, 520 the stop devices 4, 5 are brought to such a length, that their retaining bars 45, 55 find themselves in the transport path of the empty spool which is being moved by the transport band 110. When the empty spool 12 reaches the retaining bars 45 or 55, then the empty spool 12 is halted in progress by the stop device 4 or 5, which is now performing a stop function.

Then the grasping apparatus 3 is pivoted out of the plane $E_1$, which it had assumed during the travel of the maintenance conveyance 2, into the plane $E_8$. The grasping apparatus 3 is then extended in length in such a way, that its grasping claws 350 and 351, circumferentially grasp the empty spool, loosely, at first. By means of activating the drive 36, the grasping apparatus 3 now seizes the empty spool 12, whereupon, by activation of the drive 44 or 55, the empty spool is now confined between the two retaining bars 45 and 55 of the coacting stop devices 4 and 5, now functioning as a retaining arrangement 8. In this way, the empty spool 12 is brought into the exact position opposite to the grasping apparatus 3 and in this position is aligned in an axial direction.

Since the empty spool 12 of the spool assembly 10, at which the maintenance conveyance 2 at this time finds itself, is required, the grasping apparatus 3, and the retaining arrangement 8, do not return to their starting positions in planes $E_1$, $E_2$, but are immediately transferred to their positions in which the grasping apparatus 3 locates in the plane $E_5$ and the retaining arrangement 8 in the plane $E_6$. Obviously, when this occurs, the drives 34, 420 and 520 are put into operation in such a manner that the required pivoting movement is not disadvantaged by the empty spool conveyor 11 or by other elements, which are not depicted. Further the retaining bars 45 and 55, during this complex movement, remain continually situated at the two ends of the empty spool 12. When the grasping apparatus 3 as well as the retaining arrangement 8 have reached their positions in the planes $E_5$ and E6 in the nearest possible proximity to the empty spool delivery point, then the retaining arrangement 8, by activating its drives 44 and 55 releases the empty spool 12, so that the grasping apparatus 3, by extending its active length, can insert the empty spool 12 between the two spool disks 102.

If the flexibly held spool disks 102 have taken over the empty spool 12, then, by the activation of the drive 36 of the grasper 35 of the grasping apparatus 3 opens, and the grasping apparatus 3 can, by retracting its active length, remove itself from the area of the spool assembly 10.

The fourth course of the procedure is as this has already been described. By means of one of the two retaining bars 45, 55—dependent upon the feed or transport direction $T_1$ or $T_2$ (see the dashed line representation in FIG. 2) of the incoming empty spools—the empty spool 12 which has being conveyed in, is stopped, seized by the grasping apparatus 3 and is axially confined by the two stop devices 4 and 5 which form, in common, the retaining arrangement 8. The grasping apparatus 3 with the empty spool 12, now returns to its position in the plane $E_1$, whereby the retaining arrangement 8 follows this motion into the plane $E_2$ so that the two retaining bars 45 and 55, at no moment, interrupt the axial retaining of the empty spool 12 now being held by the grasping apparatus 3. The maintenance conveyance 2 is thus made ready for the next replacement of a full spool by an empty spool 12.

In accord with the described process, the empty spool 12—independently thereof, as to whether or not the maintenance conveyance 2 has already reached the spool apparatus 1, which is to be equipped with an empty spool 12—is always aligned after its pickup by the grasper 35 of the grasping apparatus 3 in an axial direction in reference to the grasping apparatus 3, with the aid of the retaining arrangement 8 serving as coacting stop devices 4 and 5. This axial alignment or securement of the empty spool 12 will be continued as long as possible, but not longer than immediately before the delivery of the empty spool 12 to the spool assembly 10 of the spool station 1 to be served. For the simplification of the correlating of motion sequencing of the grasping apparatus 3 and the stop devices 4 and 5, it will suffice, if the stop devices 4 and 5 release the empty spool 12 at an earlier time, that is, shortly after the arrival of the maintenance conveyance 2 at the spool station 1, which station requires said empty spool 12. Also satisfactory would be shortly after the beginning of the placement movement of the grasping apparatus 3 at said spool assembly 10.

In accord with the previously explained method of the process, the empty spool 12, during its pickup by the grasping apparatus 3 is aligned and secured in an axial direction, in relation to the grasping apparatus 3, by the coacting stop devices 4 and 5.

It is, however, also possible, after the stopping of an empty spool 12 by one of the two stop devices 4 or 5, to so pivot the other stop device 5 or 4, that the empty spool is aligned or positioned opposite to the grasping apparatus 3. This requires appropriate control of one or both drives 44 and/or 54. The result of this is that, the empty spool 12 possesses, already before its pickup, the desired axial relative positioning to said grasping apparatus 3 (see the retaining bars 45' and 55' in FIG. 1).

In accord with the design and the control of the maintenance conveyance 2 and the components and elements which are carried thereon, the axial alignment and/or retaining of the empty spool 12 can be carried out simultaneously in connection with its capture by the grasping apparatus 3. For the simplification of the movement-control of the grasping apparatus 3 and that of the stop devices 4 and 5, as well as of their reciprocal coaction—or on other grounds—it would be entirely sufficient, if after the stopping of the empty spool 12, and upon its capture by the grasper 35 of the grasping apparatus 3, the retaining arrangement 8, did not exercise its retaining action, but rather, by the energizing of the drives 44 and 54 and the pivoting drives 40 and 50, then carried out the said retaining action, after the grasping apparatus 3 had taken up its position in the plane $E_1$. This can occur, before the maintenance conveyance 2 has undertaken its travel to the next spool station 1 which requires service. But at the latest, this should be done shortly after the start of this travel. In this way, assurance will be given, that the empty spool 12, during the travel of the maintenance conveyance 2 and eventually after its takeover by the grasping apparatus 3, will be axially secured and aligned and, if necessary, also positioned.

In accord with the last described process variant, the alignment and securement of the empty spool is limited to the time during which the maintenance apparatus 2 is underway between two spool stations. It is sufficient, if at least during this phase, the empty spool 12 is axially secured and aligned, since no significant vibratory impacts from the maintenance conveyance 2 nor from its components and equipment are to be expected, while the maintenance conveyance 2 is in still-stand during the carrying out of its maintenance work.

If the either of the two stop devices 4 and 5 of the retaining arrangement 8 can also operate as a barrier means for the empty spool 12 which is brought forward by the spool conveyor 11 then, each in accordance with transport direction $T_1$ or $T_2$ (see dashed line depiction in FIG. 2) the stop device 4 or 5 comes into action and accordingly the stop device 4 or 5 is brought into an obstructing position in the transport path of the empty spool 12. As this is in progress, when the stop devices 4 and 5 can function also as an axial alignment arrangement 8, the one stop device 4 or 5, now in its stop-position in the transport path of the empty spool 12 to be stopped, now assumes (in respect to the alignment function) its idling position, which also forms its start position. The first stop device, 4 or 5 is brought out of this position into plane $E_7$ simultaneously with the second stop device 5, 4. Both can now coact as alignment arrangement 8 and align the empty spool 12. After the capture of the empty spool 12 by means of the grasper 35 of the grasp apparatus 3, the retaining arrangement 8 can, if required, interrupt its alignment function. This can be taken up again if the grasping apparatus 3 reaches its position in the plane $E_1$ with the empty spool which it holds.

Previously, a description was given, in that each of the two stop devices 4 and 5 can operate alone as a stop device for an empty spool 12 which is being transported with the help of the spool conveyor 11. This is, however, not unconditionally necessary. The stop devices 4 and 5, previously described as coacting, can, if necessary, also be placed on the grasping apparatus 3, and operate essentially as a part of a retaining arrangement 8. If this is done, it will suffice, if the slider arms 43 and 53 with their drives 44 and 54, as well as with their retaining bars 45 and 55 are placed in appropriate manner on the two sides of the carrier arm 32.

At the location, to which the stop devices are brought in the manner of FIGS. 1, 2, or at another suitable place on the maintenance conveyance 2, separate stop devices can be installed (not shown). These would be designed and controlled in known manner, and are not a part of this retaining arrangement 8.

In accord with what function the two retaining bars 45 and 55 have to fulfill, these are singly or commonly controllable, wherein this control is done with the aid of the control center 6.

As is here described, the retaining arrangement 8 is constructed in common with the two stop devices 4 and 5.

Other embodiments are likewise possible, for instance, in the form of a fork, which can confront the empty spool which is held by the grasper 35, and which the empty spool is secured and/or axially aligned, between its prongs, which, for instance form a conically opening between them for the centering and/or positioning of the empty spool 12.

What is claimed is:

1. A method for the manipulation of an empty spool on a textile machine comprising the steps of:

transporting the empty spool by a spool conveyor along a plurality of spool stations arranged next to one another;

stopping the empty spool at a specified location relative to a grasping apparatus;

picking up the empty spool by a grasping apparatus around the circumferential surface of the empty spool, whereby the grasping apparatus can move the empty spool;

retaining the empty spool in an axial direction by a stopping device being urged against at least one end of the empty spool;

discontinuing the retaining of the empty spool by the stopping device; and placing the empty spool at a spool station that requires the empty spool.

2. A method as recited in claim 1, wherein the step of discontinuing the retaining of the empty spool by the stopping device occurs immediately before the step of placing the empty spool at a spool station.

3. A method as recited in claim 1, wherein the step of retaining the empty spool in an axial direction by a stopping device occurs at a location displaced from the spool conveyor.

4. A method as recited in claim 1, comprising positioning the empty spool relative to the grasping apparatus with the stopping device before the step of picking up the empty spool by the grasping apparatus.

5. A method as recited in claim 4, wherein the step of stopping the empty spool at a specified location relative to a grasping apparatus is accomplished by the stopping device independently of the spool station that requires the empty spool.

6. A method as recited in claim 1, wherein the step of retaining the empty spool in an axial direction by a stopping device occurs at least during the movement of the grasping apparatus to the spool station that requires the empty spool.

7. A method as recited in claim 1, wherein the step of retaining the empty spool in an axial direction by a stopping device occurs before the grasping apparatus begins travel to the spool station that requires the empty spool.

8. A method as recited in claim 1, wherein the step of retaining the empty spool in an axial direction by a stopping device occurs during the step of picking up the empty spool by the grasping apparatus.

9. A method as recited in claim 1, wherein the step of retaining the empty spool in an axial direction by a stopping device occurs at least during the beginning of the movement of the empty spool to the spool station that requires the empty spool.

10. An apparatus for the manipulation of an empty spool on a textile machine comprising:

a spool conveyor for transporting the empty spool; and a maintenance conveyance which is mobile along a plurality of spool stations arranged next to one another, the maintenance conveyance having a grasping apparatus for the pickup of an empty spool in transport on the spool conveyor, the grasping apparatus grips about the circumferential surface of the empty spool and moves and releases the empty spool to a spool station, the maintenance conveyance also has a stopping device for the retention of the empty spool in a predetermined position relative to the grasping apparatus, the stopping device forms a retaining arrangement that embraces the empty spool when the empty spool is held by the grasping apparatus, the stopping device retains the empty spool in an axial direction by urging against at least one end of the empty spool, the retaining arrangement is at a location displaced from the travel path of the empty spool when the empty spool is held by the grasping apparatus, the retaining arrangement can be brought into an operational position to axially align the empty spool held by the grasping apparatus.

11. An apparatus as recited in claim 10, wherein the retaining arrangement is movable from an idling position and into an operational position in a transport path of the empty spool that is moving on the spool conveyor.

12. An apparatus as recited in claim 10, wherein the retaining arrangement maintains a retaining configuration during movement of the grasping apparatus between the pickup point at which the grasping apparatus seizes the empty spool that was conveyed by the spool conveyor, and the travel position which the grasping apparatus assumes during the travel taken by the maintenance conveyance to the spool station which is subject to maintenance.

13. An apparatus as recited in claim 10, wherein the retaining arrangement maintains a retaining position at least until the beginning of the motion of the grasping apparatus to the release of the empty spool on the spool station that requires the empty spool.

14. An apparatus as recited in claim 10, wherein the retaining arrangement functions as a positioning apparatus.

15. An apparatus as recited in claim 10, wherein the retaining arrangement has two controllable retainer bars between which the empty spool is axially secured.

16. An apparatus as recited in claim 15, wherein the two retainer bars are individually or commonly controllable.

17. An apparatus as recited in claim 15, further comprising a control system for controlling the two retainer bars for the stopping of the empty spool in transport on the spool conveyor.

18. An apparatus as recited in claim 15, further comprising a control system for controlling the two retainer bars in common to assure axial positioning of the empty spool.

19. An apparatus as recited in claim 15, further comprising a control system for controlling the two retainer bars singly for the stopping of the empty spool in transport on the spool conveyor, and for controlling the two retainer bars in common to assure axial positioning of the empty spool.

* * * * *